US006243554B1

(12) United States Patent
Wang et al.

(10) Patent No.: US 6,243,554 B1
(45) Date of Patent: Jun. 5, 2001

(54) DEVELOPER REPLENISHING CONTAINER

(75) Inventors: Jui-Chi Wang; Robin Hsu; Ya-Li Huang; Kuan-Tung Li, all of Taichung (TW)

(73) Assignee: General Plastic Industrial Co., LTD, Taichung (TW)

( * ) Notice: Subject to any disclaimer, the term of this patent is extended or adjusted under 35 U.S.C. 154(b) by 0 days.

(21) Appl. No.: 09/628,231

(22) Filed: Jul. 28, 2000

(51) Int. Cl.[7] ..... G03G 15/08

(52) U.S. Cl. ..... 399/262; 222/DIG. 1; 399/120; 399/258

(58) Field of Search ..... 222/DIG. 1; 399/119, 399/120, 258, 262, 263

(56) References Cited

U.S. PATENT DOCUMENTS 4,307,763 * 12/1981 Wang ..... 399/262
5,669,044 * 9/1997 Cuthbert ..... 399/262
5,867,757 * 2/1999 Okazaki et al. ..... 399/262
5,970,292 * 10/1999 Miller ..... 399/262

* cited by examiner

*Primary Examiner*—Arthur T. Grimley
*Assistant Examiner*—Hoang Ngo
(74) *Attorney, Agent, or Firm*—Pro-Techtor International Services

(57) ABSTRACT

A developer replenishing container includes a container body, and a plurality of clamping strips selectively used with the container body for mounting in a copier, wherein the container body has a slide moved in and out of a frame at a bottom neck thereof for developer output control, and two locating blocks at two opposite sides of the bottom neck above the frame; the clamping strips each have a mouth adapted to receive the bottom neck of the container body, two recessed receiving portions disposed at two opposite lateral sides and facing each other and adapted to receive the locating blocks of the bottom neck, two flat positioning ribs respectively disposed in the recessed receiving portions at a bottom side and adapted for engaging into the gaps between the top side wall of the frame and the locating blocks of the bottom neck, and at least one stop rod disposed outside the mouth for positioning in a copier.

1 Claim, 7 Drawing Sheets

DEVELOPER REPLENISHING CONTAINER

BACKGROUND OF THE INVENTION

The present invention relates to developer replenishing containers for use in copiers, and more particularly to such a developer-replenishing container, which fits different models of copier.

FIGS. from 1 through 4 show various developer replenishing containers for different models of copier. These developer replenishing containers commonly comprise a container body A having a bottom neck B for developer output, and a clamping strip C mounted on the bottom neck B of the container body A for positioning in a particular model of copier. Because the clamping strip C fits a particular design of container body A, different clamping strips should be used with different designs of container body. Because the molding equipment for a developer-replenishing container is expensive, it is not economic to provide different designs of developer replenishing container for different models of copier.

SUMMARY OF THE INVENTION

The present invention has been accomplished under the circumstances in view. It is the main object of the present invention to provide a developer-replenishing container, which fits different models of copier. According to the present invention, the developer-replenishing container comprises a container body, and a plurality of clamping strips selectively used with the container body for mounting in a copier. The container body has a slide moved in and out of a frame at a bottom neck thereof for developer output control, and two locating blocks at two opposite sides of the bottom neck above the frame. The clamping strips each have a mouth adapted to receive the bottom neck of the container body, two recessed receiving portions disposed at two opposite lateral sides and facing each other and adapted to receive the locating blocks of the bottom neck, two flat positioning ribs respectively disposed in the recessed receiving portions at a bottom side and adapted for engaging into the gaps between the top side wall of the frame and the locating blocks of the bottom neck, and at least one stop rod disposed outside the mouth for positioning in a copier. By means of selectively attaching the clamping strips to the bottom neck of the container body, the developer-replenishing container fits any of a variety of copiers.

DETAILED DESCRIPTION OF THE PREFERRED EMBODIMENT

Figure 1:
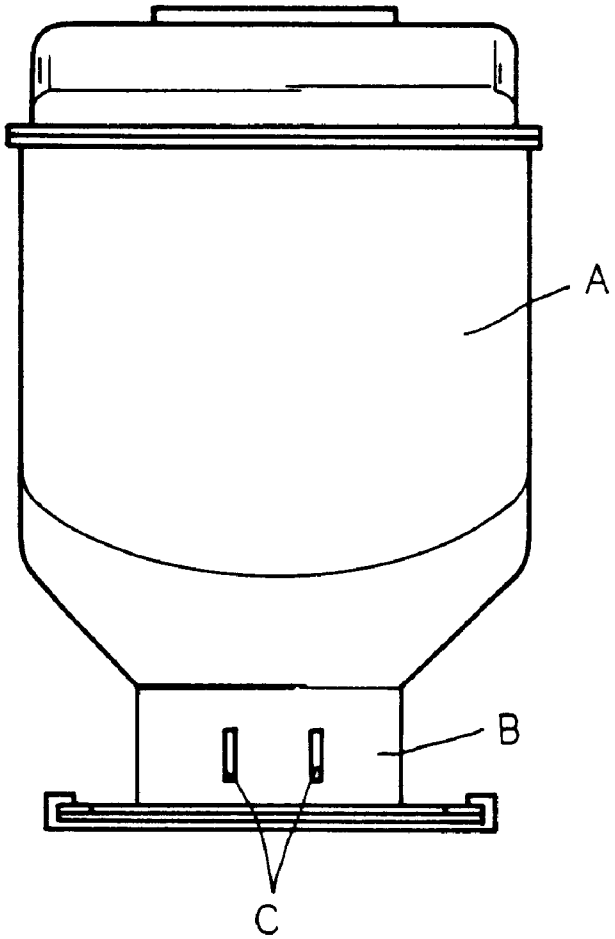
FIG.1(PRIOR ART)
FIG. 1 is a side view of a developer-replenishing container according to the prior art.
Figure 2:
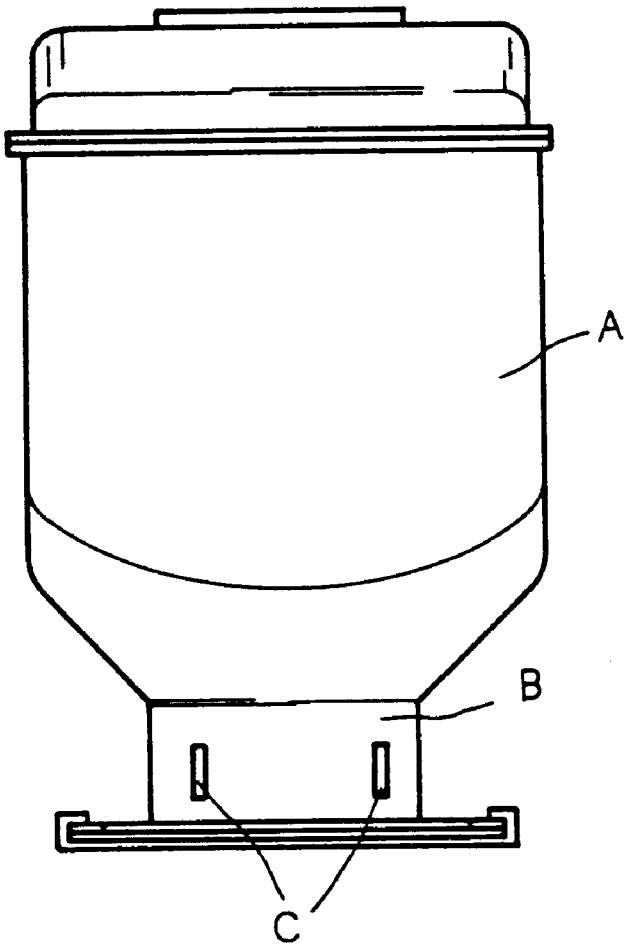
FIG.2(PRIOR ART)
FIG. 2 is a side view of another structure of developer replenishing container according to the prior art.
Figure 3:
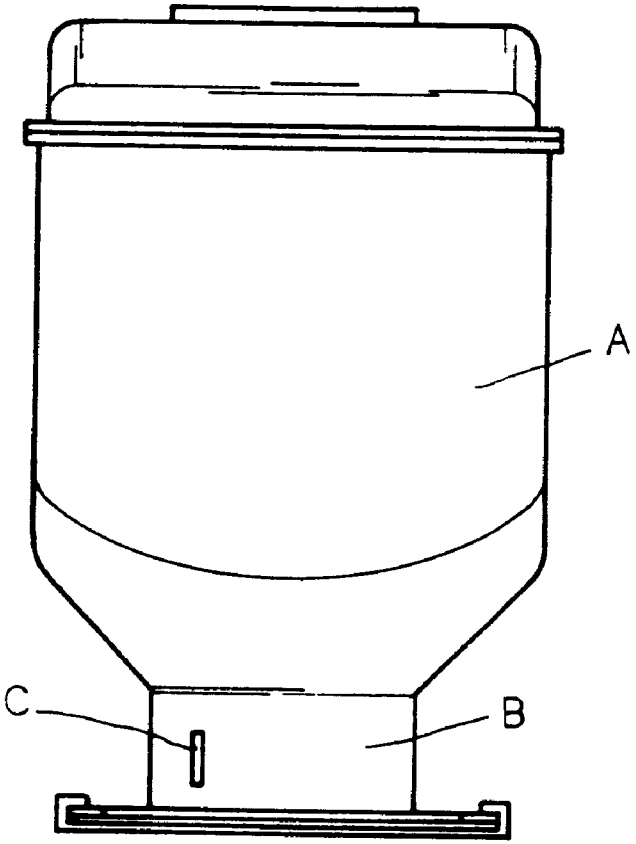
FIG.3(PRIOR ART)
FIG. 3 is a side view of still another structure of developer replenishing container according to the prior art.
Figure 4:
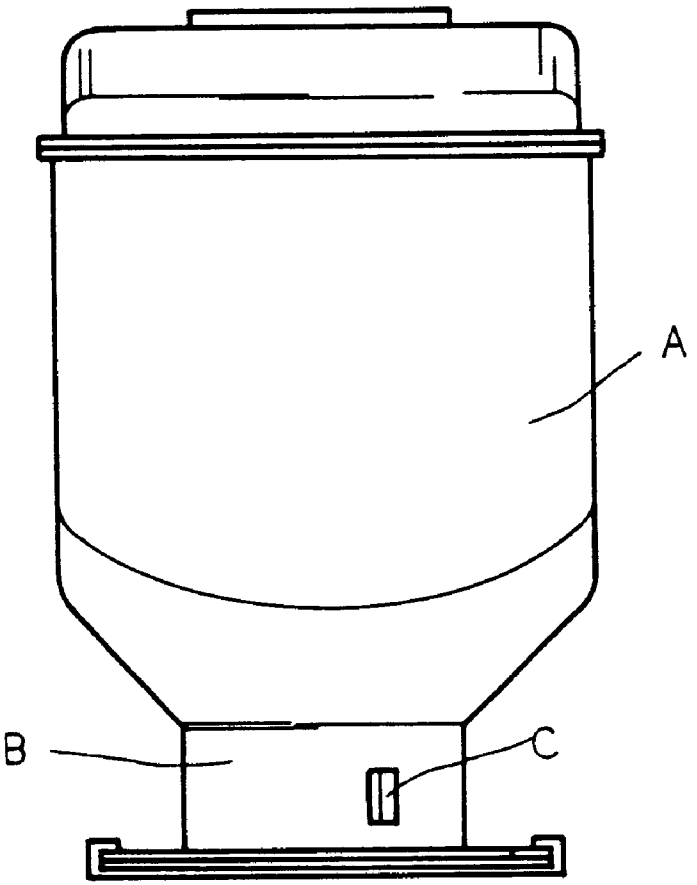
FIG. 4 (PRIOR ART)
FIG. 4 is a side view of still another structure of developer replenishing container according to the prior art.
Figure 5:
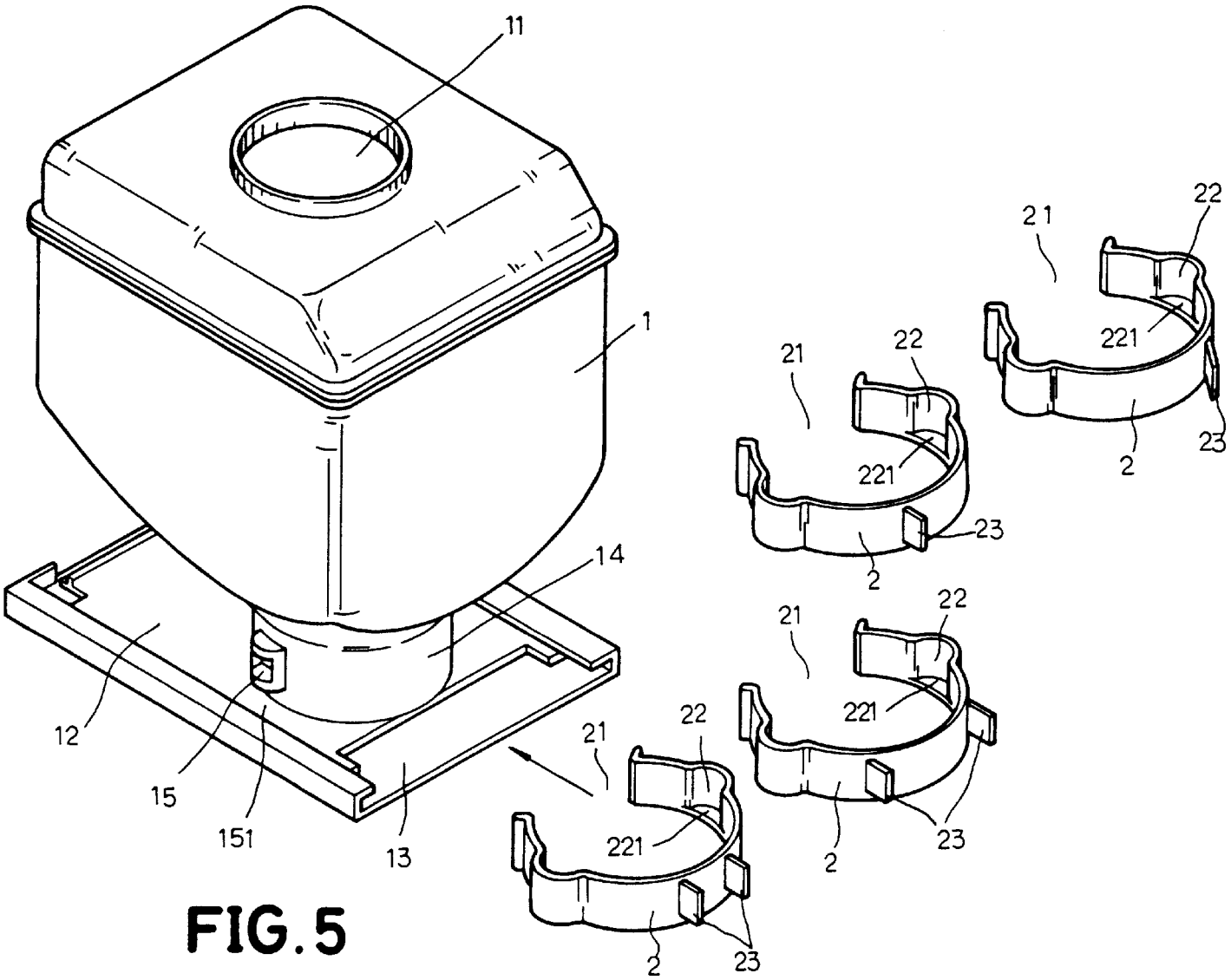
FIG. 5 is an exploded view of the present invention.
Figure 6:
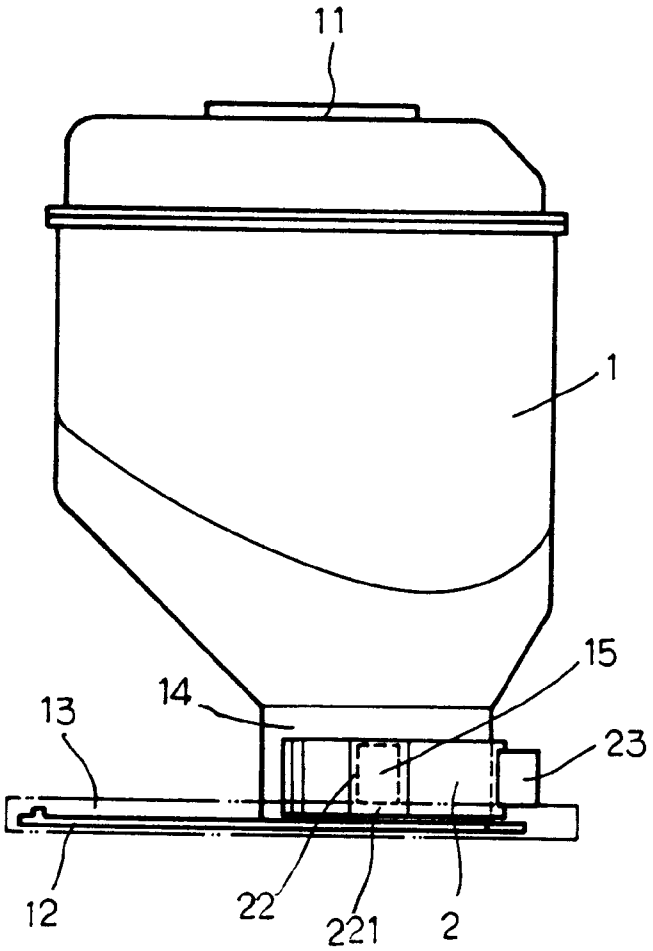
FIG. 6 is a front view showing an installation example of the present invention.

Referring to FIGS 5 and 6, a developer-replenishing container in accordance with the present invention comprises a container body 1, and a set of clamping strips 2 selectively used with the container body 1 for installation in a copier. The container body 1 has a top filling hole 11 through which developer is filled into the container body 1, a bottom neck 14 for developer output, a frame 12 integral with the distal end of the bottom neck 14, and a slide 13 moved in and out of the frame 12 to open/close the passage of the bottom neck 14. The bottom neck 14 of the container body 1 comprises two locating blocks 15 raised from the periphery thereof at two opposite sides, and respectively spaced from the topside wall of the frame 12 by a gap 151. The clamping strips 2 are shaped like an open loop, each comprising a mouth 21 adapted to receive the bottom neck 14 of the container body 1, two recessed receiving portions 22 disposed at two opposite lateral sides and facing each other and adapted to receive the locating blocks 15 of the bottom neck 14, and two flat positioning ribs 221 respectively disposed in the recessed receiving portions 22 at a bottom side and adapted for engaging into the gaps 151 between the top side wall of the frame 12 and the locating blocks 15. Each clamping strip 2 further comprises at least one stop rod 23 disposed outside the mouth 21 and adapted to fit a particular model of copier.

Figure 7:
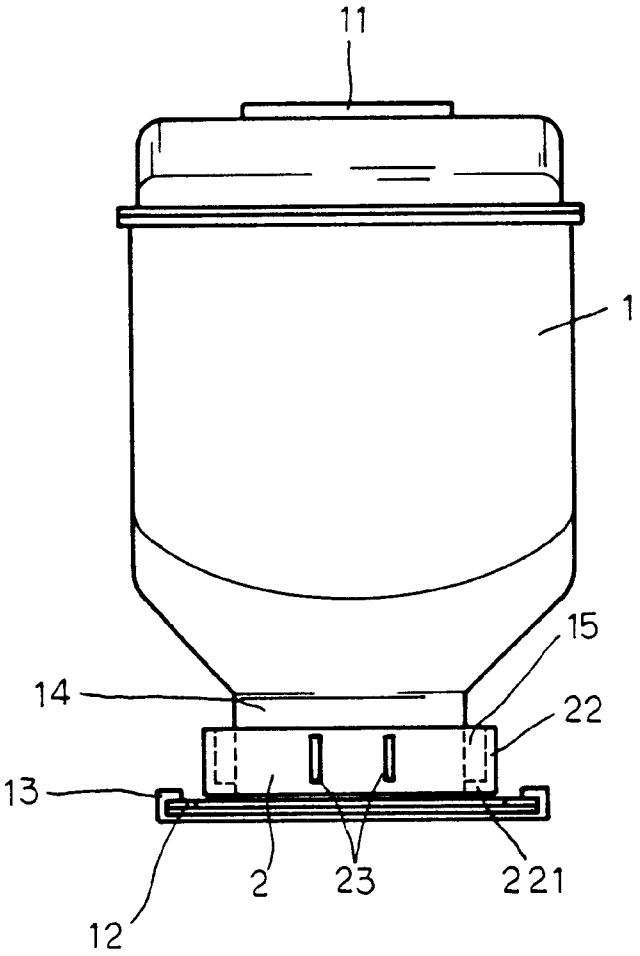
FIG. 7 is side view of FIG. 6.

Referring to FIGS. 6 and 7 and FIG. 5 again, before installation, select the desired clamping strip 2 subject to the model of copier in which the developer replenishing container is to be installed, and then attach the selected clamping strip 2 to the bottom neck 14 of the container body 1, enabling the locating blocks 15 to be respectively received in the recessed receiving portions 22 of the clamping strip 2, and then force the flat positioning ribs 221 into the gaps 151 between the top side wall of the frame 12 and the locating blocks 15. When assembled, the developer-replenishing container can then be installed into the matching model of copier.

It is to be understood that the drawings are designed for purposes of illustration only, and are not intended for use as a definition of the limits and scope of the invention disclosed.

What the invention claimed is:

1. A developer replenishing container comprising a container body, said container body comprising a top filling hole for the filling of a developer, a bottom neck for the output of the developer, a frame integral with said bottom neck, and a slide moved in and out of said frame to open/close said bottom neck, and a plurality of clamping strips selectively used with said container body for mounting in a copier, wherein said bottom neck of said container body comprises two locating blocks raised from the periphery thereof at two opposite sides and spaced from a top side wall of said frame by a gap; said clamping strips each comprise a mouth adapted to receive the bottom neck of said container body, two recessed receiving portions disposed at two opposite lateral sides and facing each other and adapted to receive the locating blocks of said bottom neck, two flat positioning ribs respectively disposed in said recessed receiving portions at a bottom side and adapted for engaging into the gaps between the top side wall of said frame and said locating blocks, and at least one stop rod disposed outside said mouth for positioning in a copier.

* * * * *